United States Patent [19]

Myers et al.

[11] 4,021,632

[45] May 3, 1977

[54] CIRCUIT BREAKER CONTACT ARM AND ATTACHMENT MEANS

[75] Inventors: Felix E. Myers, Cherry Hill, N.J.; Kenneth D. Ball; Anthony Michetti, both of Warminster; Charles E. Warner, Philadelphia, all of Pa.

[73] Assignee: I-T-E Imperial Corporation, Spring House, Pa.

[22] Filed: Jan. 23, 1976

[21] Appl. No.: 651,795

[52] U.S. Cl. ..... 200/250; 200/165; 200/244

[51] Int. Cl.[2] ..... H01H 1/50

[58] Field of Search ..... 200/165, 168, 166, 170, 200/244, 250, 253, 318; 335/42, 46, 144, 176, 273

[56] References Cited

UNITED STATES PATENTS

| | | | |
|---|---|---|---|
| 3,134,878 | 5/1964 | Jencks | 200/244 |
| 3,260,822 | 7/1966 | Stephenson, Jr. et al. | 335/42 |
| 3,263,051 | 7/1966 | Gauthier et al. | 200/250 |
| 3,299,244 | 1/1967 | Strobel et al. | 200/318 X |
| 3,518,587 | 6/1970 | Huggins | 335/46 |
| 3,564,184 | 2/1971 | Gauthier et al. | 200/244 X |

*Primary Examiner*—Volodymyr Y. Mayewsky
*Attorney, Agent, or Firm*—Ostrolenk, Faber, Gerb & Soffen

[57] ABSTRACT

In a circuit breaker, the movable contact carrying contact arm is pivotally connected to the contact carrier which pivots on the circuit breaker frame; the contact arm is stamped copper; the contact arm carrier pivot connection includes a pin passing through the walls of the carrier and with respect to which the contact arm pivots; also improved means for establishing pressure of movable contacts.

16 Claims, 8 Drawing Figures

CIRCUIT BREAKER CONTACT ARM AND ATTACHMENT MEANS

BACKGROUND OF THE INVENTION

The present invention relates to electric circuit breakers in general and particularly to the movable contact arm used in such circuit breakers. A circuit breaker of the type to which the present invention is directed is shown in U.S. Pat. No. 3,260,822 issued on July 12, 1966 to W. I. Stephenson, Jr. and E. J. Walker, entitled "Circuit Breaker with Improved Armature Adjustment Means and Armature Pivot Means" and assigned to the assignee hereof; and in U.S. Pat. No. 3,518,587 issued to W. A. Huggins on June 30, 1970, entitled "Circuit Breaker Hold Open Latch Release Means" and assigned to the assignee hereof. See also U.S. Pat. No. 3,134,878.

Circuit breakers of this type commonly include a plurality of movable contact arm assemblies. Each such assembly is comprised of a contact carrier and a contact arm that is pivotally supported on the contact carrier. The movable contact of the circuit breaker is supported on and moved by the contact arm.

Usually, the contact arm is forged from a costly conductive metal, like copper. It would be desirable to substitute a less costly contact arm. Furthermore, it would be desirable to improve the manner in which the contact arm is attached to the contact carrier.

SUMMARY OF THE INVENTION

In accordance with a first feature of the invention, the forged and quite costly conductive or copper contact arm is replaced with a much less costly stamped conductive or copper contact arm and the design and shaping of the contact arm is simplified.

In accordance with a second aspect of the design, the manner of connection between the contact arm and contact carrier is simplified, and the pivot connection is simplified to have a minimal number of parts and to simplify the manner of connection between the contact carrier and arm. In each of the below described embodiments of the invention, a pivot pin connection between the contact carrier and the contact arm is provided and an effort is made to strengthen the connection and minimize the number of parts involved in the connection.

Accordingly, it is the primary object of the invention to provide an effective means for joining the contact carrier and contact arm in a circuit breaker.

It is a further object of the invention to simplify the manner in which the contact arm is attached to the contact carrier.

It is another object of the invention to reduce the cost of manufacture of a contact arm.

These and other objects of the invention will become apparent from the following description of the preferred embodiments of the invention taken in conjunction with the accompanying drawings.

DETAILED DESCRIPTION OF THE PREFERRED EMBODIMENTS

Figure 1:
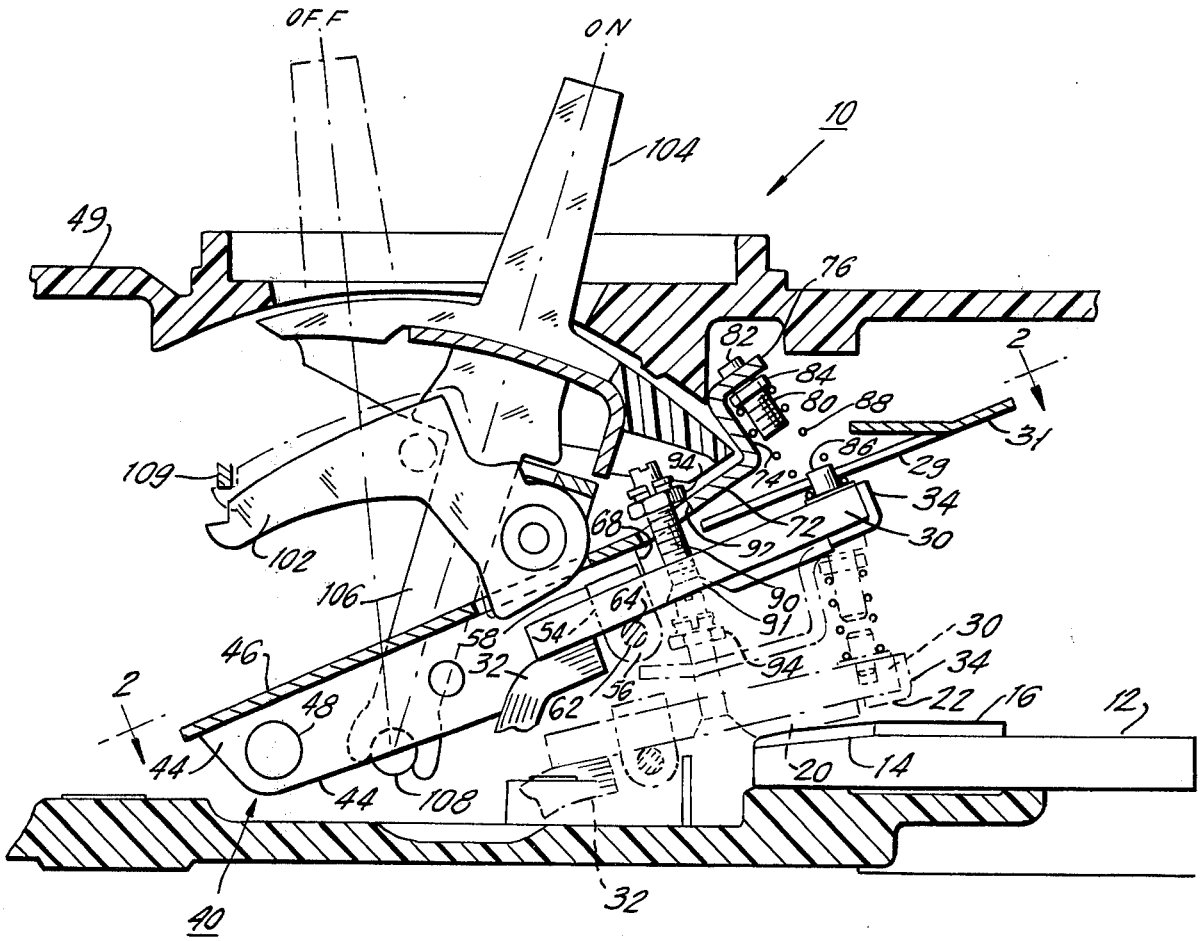
FIG. 1 is a side elevational view of a fragment of a circuit breaker incorporating a first embodiment of contact carrier and contact arm assembly according to the invention.

Referring to FIG. 1, a fragment of one phase 10 of a circuit breaker is there illustrated. Such circuit breakers are typically employed in a three phase arrangement, as shown in U.S. Pat. No. 3,518,587, although single phase arrangements and other arrangements known in the art may be used. The current path through circuit breaker phase 10 proceeds from line terminal strap 12, stationary contacts 14, 16, movable contacts 20, 22 which are carried on contact arm 30 according to the invention, and into flexible braid 32 which leads to a load carrier strap (not shown) which in turn leads to load terminals (not shown).

Because circuit breaker phase 10 has a relatively high current carrying capacity, cooperating contacts 16, 22 function as arcing contacts and are situated to engage and disengage within the opening 29 provided in the arc chute assembly 31.

Figure 2:
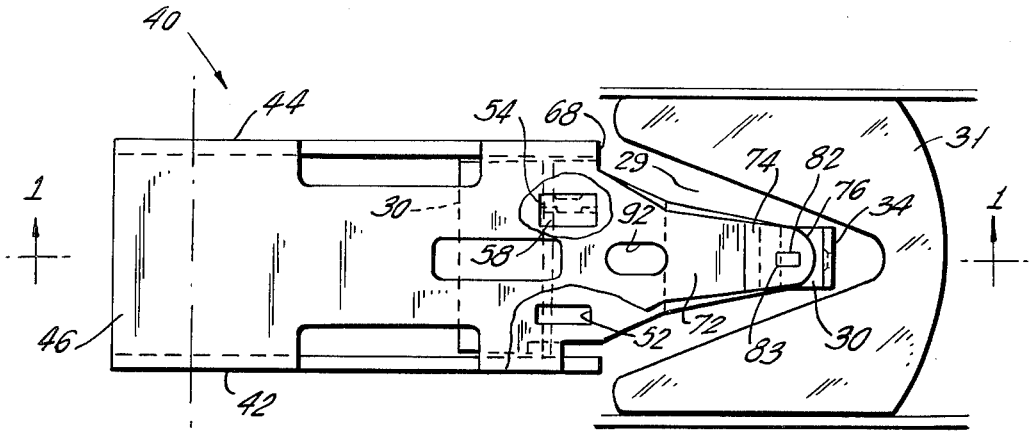
FIG. 2 is a top plan view of the contact arm and contact carrier assembly of FIG. 1 viewed in the direction of arrows 2 in FIG. 1.

In accordance with the present invention, contact arm 30 is stamped from a single sheet of copper and is generally flat and of uniform thickness as indicated in FIG. 1 and has the tapering side configuration shown in FIG. 2.

Because contact arm 30 is stamped from a substantially flat sheet or bar, it is adapted to have its arcing contact 22 protect not only the lower surface of its tip but to also curl around as at 34 to cover the front end of the contact arm 30, protecting the contact arm from scarring or damage due to arcing.

Contact arm 30 cooperates with and is pivotally fastened in the manner described below to contact carrier 40. The pivot connection for the contact arm 30 is required for circuit breakers of this type in order to ensure that the movable contacts 20, 22 will securely engage the stationary contacts 14, 16, without extremely fine adjustments in the starting point, length of path and terminal point of the path of pivotal travel of contact carrier 40 being required. Contact carrier 40 is a generally U-shaped bracket having a first wall 42 and a second wall 44 that are joined by an upper surface web 46. Contact carrier 40 is pivotally mounted at its pivot 48 in appropriate bearings (not shown) in a circuit breaker support frame 49, in a manner not shown but conventional in the art. The carrier 40 may move only by pivoting about pivot 48.

The stamped contact arm 30 is connected to and supported by the contact carrier 40. Two narrow width slots 52, 54 pass completely through contact arm 30. Through slot 54 is passed the downwardly extending leg 56 of an L-shaped bracket, whose other leg 58 seats against the top surface of contact arm 30 and extends toward slot 52. A similar L-shaped bracket (not shown) passes through slot 52 and has an arm extending toward slot 54. Located in arm 56 and passing therethrough is a hole 62. A rod 64 extends across the contact arm 30 between the hole 62 in arm 56 and the corresponding hole in the other L-shaped bracket (not shown). Appropriate securement means such as staking or E-rings (not shown) are used to hold the rod 64 in the hole 62 and the corresponding hole in the other bracket. The combination of the L-shaped brackets and the rod 64 provide the type of rigid, yet slightly pivotable connection that is required and that is found in circuit breakers of this type. The location of hole 62 and the corresponding hole in the other L-shaped bracket is such that the rod 64 squeezes the contact arm 30 securely between the rod 64 and the L-shaped bracket arm 58 and the corresponding arm (not shown) on the other L-shaped bracket.

The pivotable connection between the contact arm 30 and the contact carrier 40 at the shaft 64 and the cooperating L-shaped brackets is provided so that the stationary and movable contacts will be in secure spring caused engagement, without damage to the contacts due to excessive pressure being applied thereto by the movement of the contact carrier to the "on" contacts engaged condition. Once the movable contact 20, 22 first engage the stationary contacts 14, 16 and adequate contact pressure is established, the contact carrier 40 should stop pivoting. But fine tuning a circuit breaker to have the contact carrier stop at the precise pivoting location is impractical and time consuming. Hence, the below described spring 88 is provided to absorb the anticipated overtravel of the contact carrier 40. The continued pivoting of contact arm 30 under the influence of contact carrier 40 is halted by the engagement of the stationary and movable contacts. The continuing or overtravel of the contact carrier 40 is accounted for in the pivot connection described just above.

The pressure of contacts 20, 22 on stationary contacts 14, 16, respectively, is adjustable using the following elements. The contact carrier web 46 extends past the end 68 of the contact carrier side wall 44. Beyond that location, the web 46 inclines upwardly as shown in FIG. 1 through its section 72 up to the stud support 74, which includes the stud supporting leg 76.

A threaded surface stud 80 having a narrowed, rectangular cross section upper portion 82 passes through a cooperatingly rectangularly shaped opening 83 in web leg 76. The larger cross section of the threaded lower portion of the stud 80 keeps the stud in position under the influence of the below described spring 88. Threaded onto stud 80 is the spring pressure adjustment nut 84 which may be threadedly moved along the stud 80. Secured on the top surface of the contact arm 30 is the spring retainer 86. Compression spring 88 extends between the nut 84 and the top of the contact arm 30 at retainer 86. With the contact carrier 40 and contact arm 30 at the contact engaged position (the broken line, phantom position in FIG. 1), the spring 88 forces the contacts 20, 22 into engagement with their respective stationary contacts 14, 16.

Means for initially tensioning spring 88 and also for determining the extent to which the contact arm 30 will pivot with respect to the contact carrier 40 comprises the stud 90 which passes through an opening through contact arm 30 and whose head 91 engages the contact arm. The contact carrier web portion 72 has a clearance opening 92 through it through which passes the shaft of the stud 90. The periphery of the upper portion of stud 90 is threaded to receive the lock nut 94, whose exterior cross section is sufficiently wide that the lock nut rests on and engages the surface surrounding the opening 92. The nut 94 may be threadedly moved along the shaft of the stud 90. As the nut 94 is tightened along the shaft 90, the tension of spring 88 is increased. Also, nut 94 controls the angle through which the contact carrier 40 pivots once the contacts 20, 22 first make contact with the contacts 14, 16. Once the contacts have made contact, carrier 40 pivots from the position in engagement with the nut 94 to the condition where the contact carrier 40 has been pivoted away from the nut 94 by the continued clockwise pivoting of contact carrier 40 after initial engagement between the contacts 20, 22 and 14, 16, respectively as shown in the broken line condition of FIG. 1.

The circuit breaker operating mechanism is not shown or described in detail herein, it being well know in the art and shown in U.S. Pat. No. 3,518,587, incorporated herein by reference. The circuit breaker 10, like any of its type, includes the cradle 102, the handle 104 secured to the handle frame 106 which pivots on the circuit breaker frame supported handle pivot 108. The cradle is latched by the releasable latch 109 which is part of the remaining operating mechanism of the circuit breaker (not shown). The remaining mechanisms of a circuit breaker are not shown herein, their not being necessary for an understanding of the invention.

Figure 4:
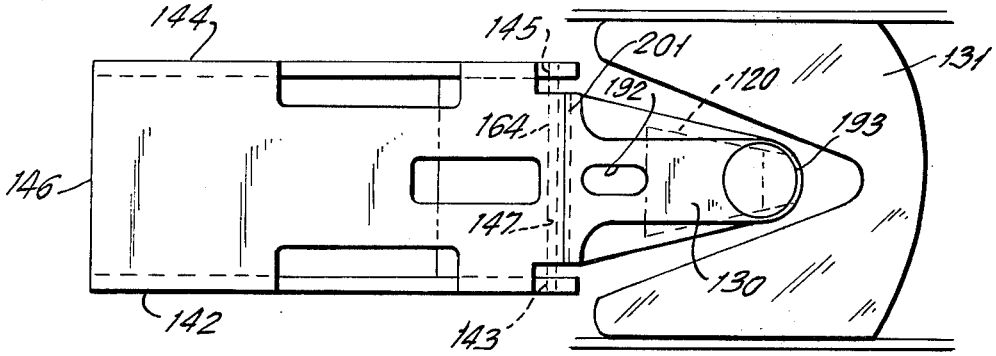
FIG. 4 is a top plan view of the contact arm and contact carrier assembly viewed in the direction of arrows 4 in FIG. 3.
Figure 3:
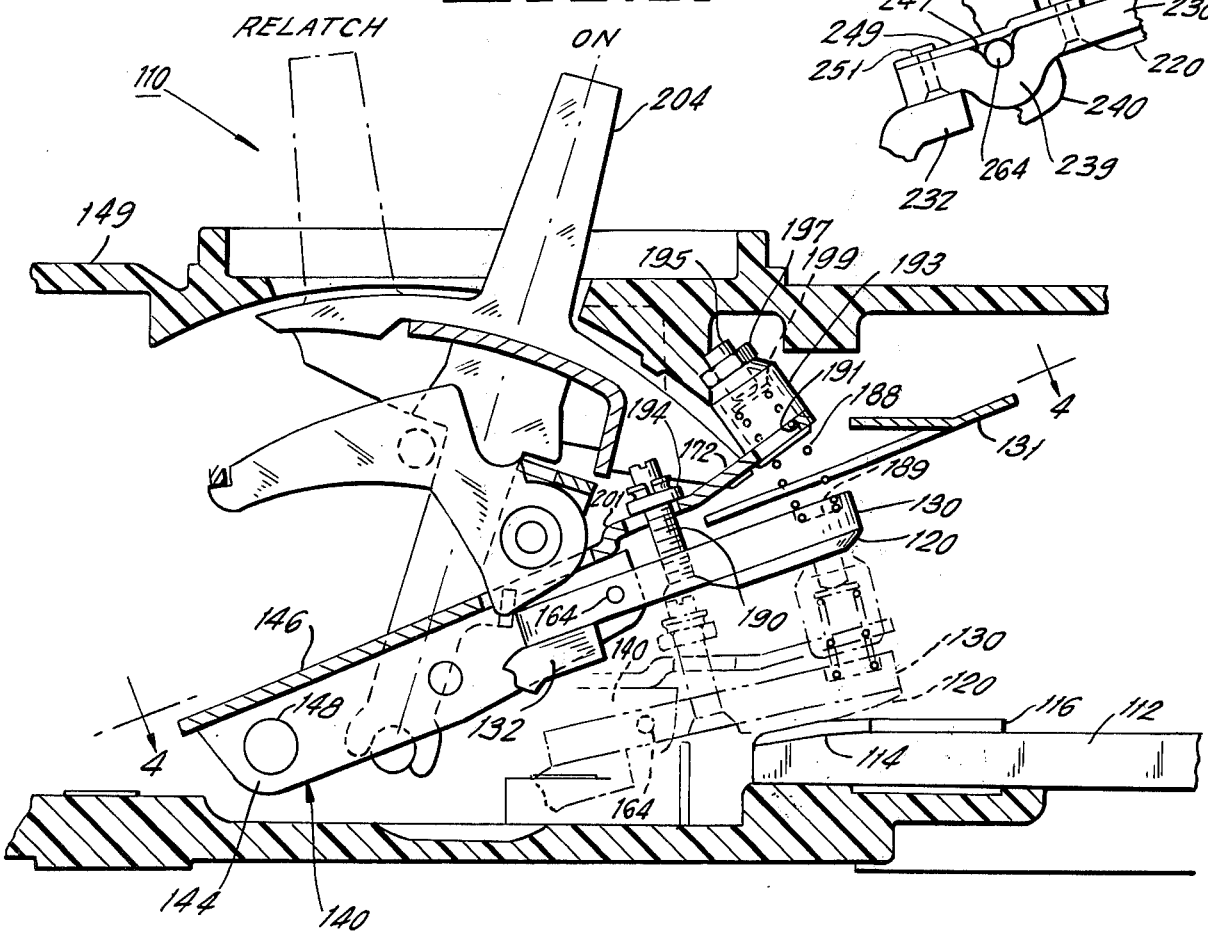
FIG. 3 is a side elevational view of a fragment of a circuit breaker incorporating a second embodiment of contact arm and contact carrier assembly according to the invention.

The second embodiment of circuit breaker 110 of FIGS. 3 and 4 is now described. Those elements in the second embodiment that correspond in structure and function to those in the first embodiment will be correspondingly numbered, with the reference numerals raised by 100.

In the second embodiment of FIGS. 3 and 4, contact arm 130 differs from contact arm 30 in a number of respects. Contact arm 30 is stamped from a sheet or bar of copper as is contact arm 30. Instead of two contacts 20, 22 beneath contact arm 30, there is but one movable contact 120 which is of a length sufficient to serve as the main and the arcing contacts.

A pin receiving hole 143 passes through contact carrier side wall 142 and a corresponding pin receiving hole 145 passes through contact side wall 144. Through the center, between its top and bottom, of and across the contact arm 130 passes a bored hole 147 that is aligned with the holes 143 and 145. Through the aligned holes 143, 147, 145 passes the tight fit pivot pin 164. The pivot pin 164 is held in place by staking or by the use of E-rings or the like securement means, similar to pin 64. The contact pressure adjustment structure in the second embodiment of FIGS. 3 and 4 is functionally and structurally analogous to that of the first embodiment. It includes the spring 188 which is received in a spring retainer well 189 on the top surface of contact arm 130. The spring passes through an opening 191 formed in the inclined portion 172 of contact carrier web 146. A spring supporting sleeve 193 receives a screw threaded stud 195 at its upper end, which stud is held at the desired degree of tightening by the nut 197. At the base of stud 195 is the abutment surface 199 against which spring 188 presses. To adjust contact pressure, the height of abutment surface 199 aboce the top surface of section 172 of web 146 determines the tension on spring 188.

To obtain the desired height for section 172 of web 146 when it engages nut 194 on stud 190, web 146 has a hump 201 therein at which the web 146 is buckled to achieve the desired height for web section 172 with respect to nut 194.

As shown by a comparison of the solid line and broken, phantom line positions of the contact carrier 140 with respect to the contact arm 130, the contact arm 130 pivots about the pivot 164 once the contact 120 has engaged the cooperating stationary contacts 114, 116.

From the description of the first embodiment in FIGS. 1 and 2, other features of the second embodiment can be understood.

Figure 5:
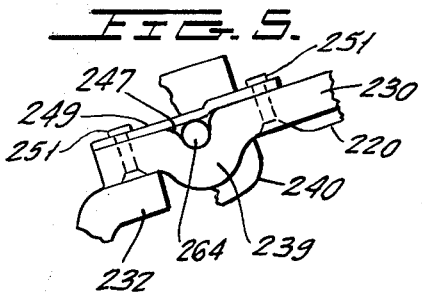
FIG. 5 is a view of the same type assembly as in FIG. 3 with a modified connection between the contact carrier and contact arm according to a third embodiment of the invention.

FIG. 5 shows a third embodiment which is a slight modification from the third embodiment shown in FIGS. 3 and 4. In FIG. 5, those elements similar or identical to the corresponding elements shown in FIGS. 3 and 4 are correspondingly numbered with the reference numerals raised by another 100.

Instead of the hole 147 which was bored through the contact arm 130, the contact arm 230 is bent or humped at 239 during the stamping procedure to define the pin receiving channel 247 that extends across the entire contact arm 230. The channel 247 is shaped and of sufficient depth to receive the pivot pin 264 which passes through receiving holes (not shown), which are like holes 143 and 145, in the side walls of the contact carrier 240. A pin securement plate 249 is riveted to contact arm 230 over the pin 264 and channel 247 by rivets 251. Contact arm 230 is shown folded to form channel 247 at the top side thereof. But, the folding of arm 230 could be such as to have channel 247 at the underside of arm 230. The embodiment of FIG. 5 is structurally quite similar to that of FIGS. 3 and 4 and operates in the same manner.

Figure 6:
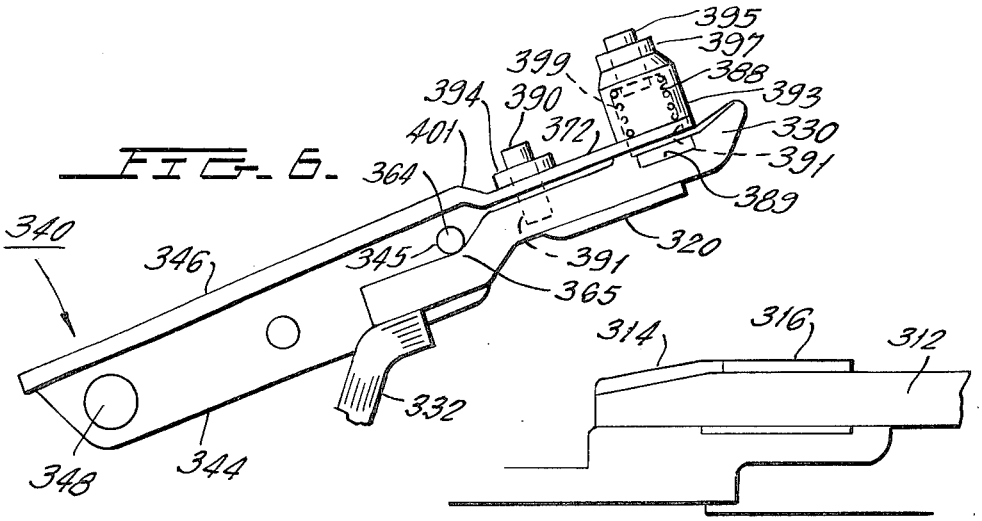
FIG. 6 is a side elevational view of the type shown in FIG. 1 of a fourth embodiment of contact arm and contact carrier assembly according to the invention.

In the fourth embodiment of FIG. 6, the elements corresponding to those shown in the second embodiment of FIG. 3 and which are structurally and functionally similar are identified by the same reference numerals as in FIG. 3, raised by 200. A pivot pin 364 extends completely across the contact carrier 340 and is supported in receiving opening 345 in the wall 344 and a cooperating opening in the corresponding other wall (not shown) of the carrier 340. The opening 345 in which the pin 364 is carried is large enough to permit the pin to pivot, yet small enough to hold it in a fixed orientation. The contact arm 330, during its stamping, was bent to form the curved depression 365 which is shaped to conform to a substantial part of the arcuate periphery of shaft 364. The shaft 364 is brazed to the stamped contact arm in the curved depression 365, whereby the pin 364 and the contact arm 330 pivot together with respect to the contact carrier 340.

The means for maintaining proper contact pressure of the movable contact 320 with respect to the stationary contacts 314, 316 is now described. Instead of inclining upwardly as in FIG. 3, the extended portion 372 of web 346 in FIG. 6 has a slight downward hump 401 to bring the web portion 372 quite close to the top surface of the contact arm 330. As a result, the spring 388 is quite short as compared with the spring 188 of FIG. 3. Yet, the spring 388 and the structures supporting it function in the same manner. In similar fashion, the stud 390 is much shorter than the stud 190. In the illustrated arrangement, the stud 390 does not pass completely through the contact arm 330, but is instead screwed tight into a receiving threaded bore 391 which passes partially through the contact arm 330 from the top.

The fifth embodiment of contact arm, contact carrier assembly of FIG. 7 again shares many features in common with the second embodiment of FIG. 3. The reference numerals used in FIG. 7 for structurally and functionally analogous structures to those in FIG. 3 will be the same reference numerals as were used in FIG. 3, raised by 300.

Figure 7:
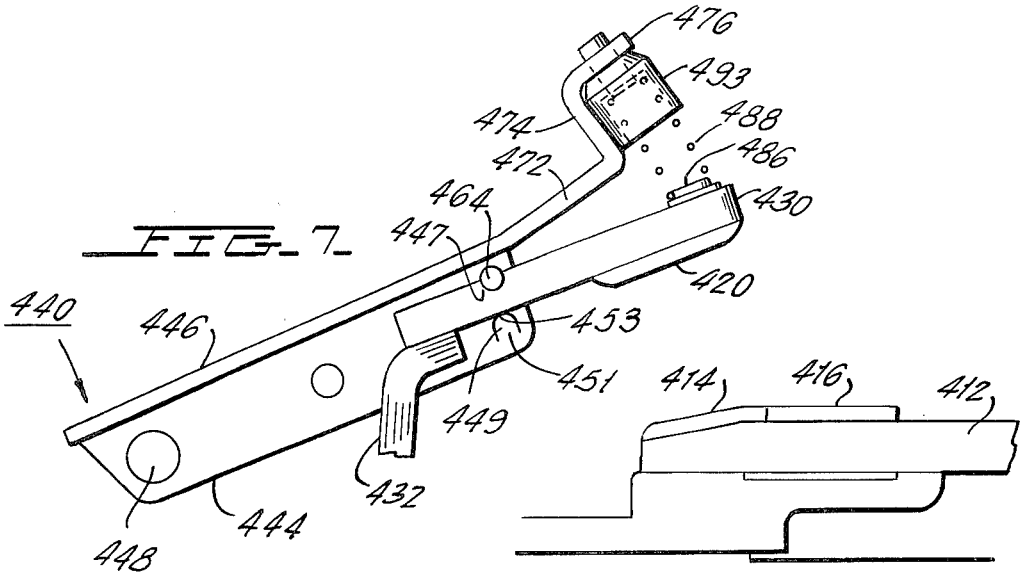
FIG. 7 is a side elevational view of the type shown in FIG. 1 of a fifth embodiment of contact arm and contact carrier assembly according to the invention.

In FIG. 7, an arcuate groove 447 is formed in the top surface of and extends completely across the top surface of contact arm 430. The curvature of the arc of groove 447 corresponds to the curvature of the pivot pin 464 which seats in that groove. (Compare the embodiment of FIG. 5.) The pivot pin 464 extends through the wall 444 of the contact carrier 440 and the other wall (not shown) of the contact carrier 440 and pin 464 is supported by these walls against shifting. The pin may be appropriately staked, held by E-rings or be held by the like manner of securement.

The side wall 444 of contact carrier 440 is lanced or partially punched through and bent inwardly to form the tab 449, whose bottom side 451 is integrally attached to the wall 444 of the contact carrier and whose upper, inwardly bent side 453 presses against the underside of the contact arm 430. It is apparent that the tab 449 will be lanced in the wall 444 at a location such that the upper edge 453 of the tab will provide the support for contact arm 430 to hold the pivot pin 464 securely in its receiving groove 447. The opposite side wall of the contact carrier 440 (not shown) will be provided with a corresponding lanced tab and these tabs will support the contact arm 430 against the pin 464.

The contact spring arrangement shown in FIG. 7 is similar to that shown in FIG. 6 except that the housing 493 is carried on the arm 476 of the L-bend 474 in web 446 and the spring 488 is supported on the stud 486 atop the contact arm 430.

Figure 8:
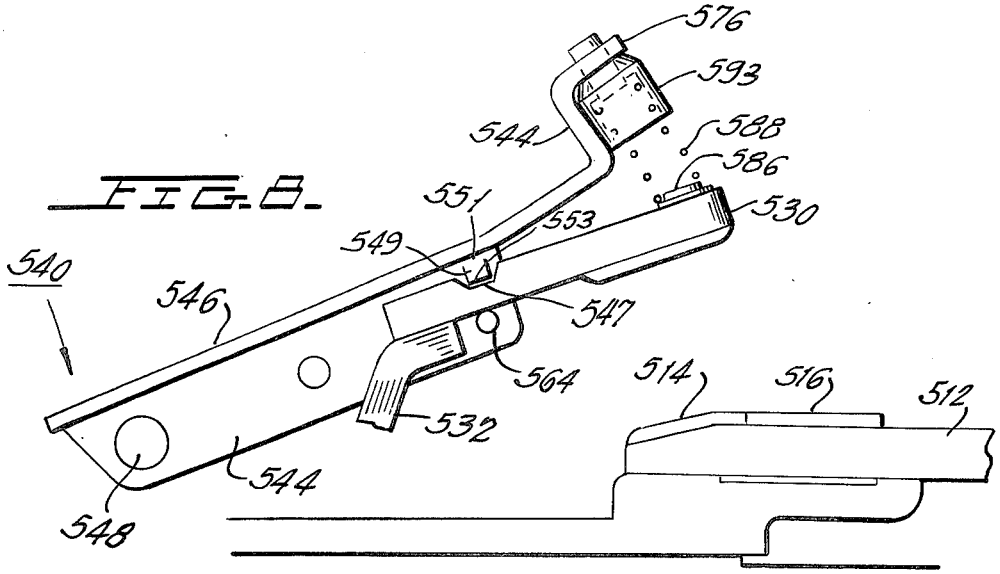
FIG. 8 is a side elevational view of the type shown in FIG. 1 of a sixth embodiment of contact arm and contact carrier assembly according to the invention.

The sixth embodiment of contact arm, contact carrier assembly shown in FIG. 8 is quite analogous to the fifth embodiment shown in FIG. 7. Those elements in FIG. 8 that are analogous in function and structure to those shown in FIG. 7 are correspondingly numbered to the elements in FIG. 7 with the numbers in FIG. 8 raised by 100.

The embodiment of FIG. 8 differs from that of FIG. 7 principally in the reversal in position of the pivot pin 564 from being above to being below the contact arm 530 and the corresponding reversal of the lanced tab 549, as compared with the embodiment of FIG. 7. In FIG. 8, the pivot pin 564 is positioned below the contact arm 530 and extends between the side wall 544 of the contact carrier 540 and the other side wall (not shown) of the contact carrier. The contact arm 530 rests on the pivot pin 564 and may pivot thereabout.

The inwardly lanced tab 549 is attached at its upper end 551 to the side wall 544 and its slightly inwardly bent free edge 553 rests in the notch 547 that is formed in the upper surface of contact arm 530 and is shaped to correspond with the contour of the lanced tab 549, thereby to hold the contact arm 530 securely against shifting. With this arrangement, it is apparent that the contact arm 530 can pivot about the pivot pin 564 during operation of the unit.

There has just been described a number of embodiments of connections between the contact carrying arm 30, 130 et al and the circuit breaker frame supported contact carrier 40, 140, et al of a circuit breaker, wherein the contact arm is pivotally carried on the contact carrier and wherein the pivot connection is as simple as practicable and further wherein the contact arm is preferably stamped from conductive metal.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

We claim:

1. In a circuit breaker, comprising: a casing, a stationary contact, a movable contact movable into and out of engagement with said stationary contact, said contacts being within said casing;

an electrically conductive contact arm; said contact arm including an underside having a surface; said contact arm including a top side having a respective surface and being on the opposite side of said contact arm from said underside; a conductive connection connected to said contact arm and leading away therefrom; said contact arm having a direction of extension between one end and an opposite end thereof; said movable contact being attached to said contact arm one end and on said contact arm underside surface;

a contact carrier toward which said contact arm opposite end extends;

a contact carrier pivot mount for joining said contact carrier to said casing in a manner to permit said contact carrier to be pivoted to bring said movable and said stationary contacts into engagement and apart;

a pivot pin supported by said contact carrier and extending across said contact carrier in a direction transverse to said direction of extension of said contact arm and spaced from said contact carrier pivot mount, whereby said pivot pin is pivotable around said contact carrier pivot mount by pivoting of said contact carrier;

first means at said contact arm opposite end and on said contact arm for being engaged by said pivot pin in a manner such that said contact arm is pivotable around said pivot pin;

second means on said contact carrier for holding said contact arm to said contact carrier and on said pivot pin;

biasing means in engagement with and extending between said contact arm and said contact carrier such that said biasing means applies force to said contact arm for biasing it with said movable contact to pivot around said pivot pin toward said stationary contact; restraining means for restraining and defining the extent to which said contact arm may so pivot with respect to said contact carrier toward said stationary contact.

2. The circuit breaker of claim 1, wherein said contact arm is a stamped metal element.

3. The circuit breaker of claim 1, wherein said contact carrier has a portion that extends away from its said pivot mount, that extends beyond said pivot pin and that extends over said top of said contact arm; said biasing means extending between said contact carrier portion and said top side of said contact arm.

4. The circuit breaker of claim 3, wherein said first means comprises a slot in said contact arm and a bracket carried in said slot and supported by said contact arm; said bracket having a first opening therethrough through which said pivot pin passes; said slot being so positioned and shaped and said bracket being so shaped that when said pivot pin passes through said first opening, said pivot pin engages a said surface of said contact arm, thereby to provide a pivot for said contact arm;

said second means comprising respective second openings in said contact carrier for receiving and supporting said pivot pin; said pivot pin extending through said second openings.

5. The circuit breaker of claim 4, wherein said slot passes completely through said contact arm, through its said underside and its said top side;

said bracket being L-shaped with one leg of said bracket having said opening therethrough and that said leg extending beneath said contact arm underside and the other said leg of said bracket resting against said top side surface of said contact arm, such that said contact arm is held between said pivot pin and said bracket other leg.

6. The circuit breaker of claim 5, further comprising a second said slot spaced from the first said slot; a cooperating second said L-shaped bracket carried in said second slot; said second slot and said second L-shaped bracket being so shaped and positioned that said pivot pin passes properly through both said L-shaped bracket openings therefor.

7. The circuit breaker of claim 3, wherein said first means comprises a first opening passing through and completely across said contact arm between its said top side and its said underside and transverse to said direction of extension of said contact arm; said pivot pin passing through said first opening;

said second means comprising respective second openings in said contact carrier for receiving and supporting said pivot pin; said pivot pin extending through said second openings.

8. The circuit breaker of claim 3, wherein said first means comprises one of said top side and said underside of said contact arm having a channel defined therein which extends completely across said contact arm and transverse to said direction of extension of said contact arm; said pivot pin passing through said channel; and holding means holding said pivot pin in said channel; said channel having a shape generally conforming to the profile of said pivot pin;

said second means comprising respective openings in said contact carrier for receiving and supporting said pivot pin; said pivot pin extending through said second openings therefor.

9. The circuit breaker of claim 8, wherein said holding means comprises means closing off the open side of said channel with said pivot pin in said channel.

10. The circuit breaker of claim 9, wherein said contact arm has a fold therein which defines said channel.

11. The circuit breaker of claim 3, wherein said first means comprises a section of one of said top side and said underside of said contact arm; said contact arm section extending completely across said contact arm and transverse to said direction of extension of said contact arm;

said pivot pin being in contact with said contact arm section and being secured thereto, such that said pivot pin and said contact arm pivot together;

said second means comprising respective openings in said contact carrier for receiving and supporting said pivot pin; said pivot pin extending through said openings therefor.

12. The circuit breaker of claim 11, wherein said contact arm has a fold therein located at and defining said section thereof and said fold being shaped to define a channel; said channel having a shape generally conforming to the profile of said pivot pin.

13. The circuit breaker of claim 8, wherein said holding means comprises a tab formed in said contact carrier and extending into engagement with the other of said top side and said underside of said contact arm and so positioned as to squeeze said contact arm between said tab and said pivot pin.

14. The circuit breaker of claim 3, wherein one of said top side and said underside of said contact arm has a channel defined therein which extends completely across said contact arm and transverse to said direction of extension of said contact arm;

said second means comprising a tab formed in said contact carrier and extending into said channel in said contact arm, thereby to prevent shifting of said contact arm in its said direction of extension;

said first means comprising a section of the other of said top side and said underside of said contact arm; said contact arm section extending completely across said contact arm and transverse to said direction of extension of said contact arm;

said pivot pin being in contact with said contact arm section and said contact arm section being so located with respect to said channel such that said pivot pin is in opposition to said tab and said pivot pin forces said contact arm against said tab and vice versa;

said second means further comprising respective openings in said contact carrier for receiving and supporting said pivot pin; said pivot pin extending through said openings therefor.

15. The circuit breaker of claim 3, wherein said restraining means comprises a stud fastened to said contact arm and extending above the said top side thereof toward and past said contact carrier portion; an opening through said contact carrier portion through which said stud passes; said stud being threaded along at least that portion of its length that could pass above said contact carrier portion; a threaded nut threadedly secured on said stud and being so shaped and of a size and so positioned on said stud as to press against the side of said contact carrier facing away from said contact arm, whereby the position of said nut along said stud determines the extent to which said contact arm may pivot said movable contact toward said stationary contact under the influence of said biasing means.

16. The circuit breaker of claim 15, wherein said biasing means comprises a spring; on said top side of said contact arm is located a spring retaining means; one end of said spring is supported on its said retaining means;

on the side of said contact carrier which faces toward said contact arm top side is a second spring retaining means; said second spring retaining means comprising a threaded second stud projecting from said contact carrier toward said contact arm and a cooperating nut threaded on said second stud and threadedly movable therealong; said spring engaging said second nut such that adjustment of the position of said second nut along said second stud determines the tension of said spring and the contact force of said movable contact.

* * * * *